US007806808B2

(12) United States Patent
Kuo

(10) Patent No.: US 7,806,808 B2
(45) Date of Patent: Oct. 5, 2010

(54) ATHLETIC APPARATUS WITH NON-PARALLEL LINEAR SLIDING TRACK

(75) Inventor: Hai-Pin Kuo, Tainan (TW)

(73) Assignee: Sports Art Industrial Co., Ltd., Tainan (TW)

( * ) Notice: Subject to any disclaimer, the term of this patent is extended or adjusted under 35 U.S.C. 154(b) by 0 days.

(21) Appl. No.: 12/333,309

(22) Filed: Dec. 12, 2008

(65) Prior Publication Data

US 2010/0151999 A1 Jun. 17, 2010

(51) Int. Cl.
*A63B 22/04* (2006.01)
*A63B 71/00* (2006.01)

(52) U.S. Cl. ..... 482/52; 482/51

(58) Field of Classification Search ..... 482/51–53, 482/70, 54, 79, 80
See application file for complete search history.

(56) References Cited

U.S. PATENT DOCUMENTS 3,566,861 A * 3/1971 Weiss ..... 601/27
3,589,720 A * 6/1971 Agamian ..... 482/114
4,781,372 A * 11/1988 McCormack ..... 482/70
5,209,711 A * 5/1993 Scrima ..... 482/70
5,520,598 A * 5/1996 Little ..... 428/79
5,911,650 A * 6/1999 Cox ..... 482/70
6,277,055 B1 * 8/2001 Birrell et al. ..... 482/52
6,786,850 B2 * 9/2004 Nizamuddin ..... 482/51
6,849,032 B2 * 2/2005 Chu ..... 482/51
7,402,126 B2 * 7/2008 Chang ..... 482/52
7,455,623 B2 * 11/2008 Wang ..... 482/52
2005/0266964 A1 * 12/2005 Teng ..... 482/71
2006/0046902 A1 * 3/2006 Chang ..... 482/52
2008/0167164 A1 * 7/2008 Wang ..... 482/52

* cited by examiner

*Primary Examiner*—Loan Thanh
*Assistant Examiner*—Allana Lewin

(57) ABSTRACT

An athletic apparatus with non-parallel linear sliding tracks includes a frame, a pair of non-parallel linear tracks installed to the frame, a pair of pedal mechanisms slidably installed to the tracks and a pair of rocker arm mechanisms. Each rocker arm mechanism pivoted to a shaft rod of the frame is linked to the pedal mechanism through at least one linking rod and further connected to a damping mechanism which provides a resistance to the rocker arm mechanism. Each pedal mechanism is linked to a steel rope of a linking mechanism so that the pair of the pedal mechanisms can move back and forth against each other alternately along the non-parallel linear tracks. A handle is arranged on a top of each rocker arm mechanism, a user can exercise by holding the handles and treading on the pedal mechanism.

10 Claims, 9 Drawing Sheets

ATHLETIC APPARATUS WITH NON-PARALLEL LINEAR SLIDING TRACK

FIELD OF THE PRESENT INVENTION

The present invention relates to athletic apparatus, and particular to an athletic apparatus with a non-parallel linear sliding track and provides complicated exercise for user's hands and feet.

DESCRIPTION OF THE PRIOR ART

A plenty of athletic apparatuss are developed for the purposes of body fitness or rehabilitation. Athletic apparatuss such as a stair climber can provide an exercise for a user's feet by treading up and down on pedals only. Athletic apparatuss such as an elliptical trainer can provide an exercise for both hands and feet. Pedals of the elliptical trainer fixed to a linking rod can not be moved alone. Although the stair climber and the elliptical trainer are well developed and improved, the exercise style of the stair climber is still an upwards and downwards exercise and the style of the elliptical trainer is still an elliptical movement and the pedals still can not be slid on the supporting linking rod.

SUMMARY OF THE PRESENT INVENTION

Accordingly, the present invention provides a non-parallel linear track which means an athletic apparatus with non-parallel linear sliding tracks. The athletic apparatus provides exercise for a user's hands and feet, especially a non-parallel linear slide of good athletic effect for the user's feet.

The various objects and advantages of the present invention will be more readily understood from the following detailed description when read in conjunction with the appended drawing.

DETAILED DESCRIPTION OF THE INVENTION

Figure 1:
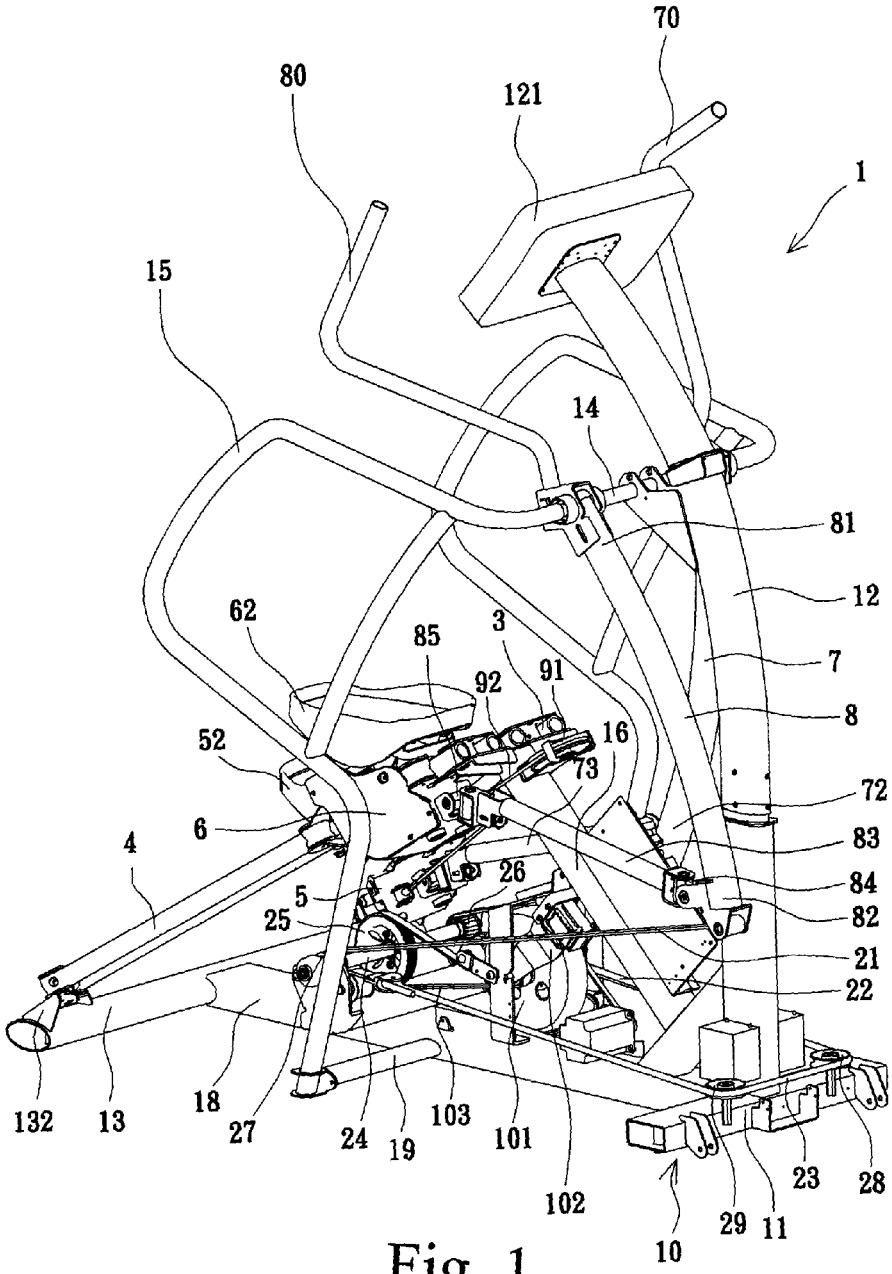
FIG. 1 is a pictorial drawing of an embodiment of an athletic apparatus of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 1, 2, 3, and 8, an athletic apparatus 1 according to the present invention is illustrated. The athletic apparatus 1 includes a frame 10, a pair of separated tracks 3 and 4, a pair of pedal mechanisms, a pair of separated rocker arm mechanisms, two transmitting mechanisms, and a damping mechanism.

The frame 10 has a base 18 which includes a front bottom rod 11 and a rear bottom rod 13 separated from each other. The front bottom rod 11 is formed as a standing rod 12, a control panel 121 is installed to a top of the standing rod 12. The users can operate the athletic apparatus 1 through the control panel 121. An axle rod 14 is formed near an upper end of the standing rod 12, handles 15 for holding by the users are formed respectively between two ends of the axle rod 14 and a middle bottom rod 19 of the base 18. Installation portions 131 and 132 are formed separately to the rear bottom rod 13.

The tracks 3 and 4 of the same structure are arranged to a left and right side of the athletic apparatus 1 respectively. Bottom ends of track 3 and 4 are fixed to the installation portions 131 and 132 respectively, while upper ends of the tracks 3 and 4 are fixed to an inclined supporting rod 16 of the frame 10 so that the left and right tracks are at an predetermined angle to the ground. A main characteristic of the tracks is that the tracks are made of non-parallel linear arrangement. The distances of the two tracks 3, 4 become smaller and smaller from the lower ends thereof to the upper ends thereof. The design of the tracks will have the users experienced the most natural exercise for feet, it is also an ergonomic design capable of protecting user's heels from being hurt.

The left and right pedal mechanisms of the same structure have pedal bases 5 and 6, supporters 51 and 61 linked to the pedal bases 5 and 6, and pedals 52 and 62 for treading by the users respectively. The pedal bases 5 and 6 are slidably installed to the inclined tracks 3 and 4 respectively and capable of being slid up and down along the tracks.

The left and right rocker arm mechanisms of the same structure have rocker arms 7 and 8 respectively. Upper ends 71 and 81 of the rocker arms 7 and 8 respectively are pivoted to the axle rod 14, and handles 70 and 80 are arranged to the rocker arms 7 and 8 respectively for holding by the users. Lower ends 72 and 82 of the rocker arms 7 and 8 are pivoted to linking rods 73 and 83 through universal connectors 74 and 84 (which are capable of rotating in Y and Z axes) respectively. Another ends of the linking rods 73 and 83 are also pivoted to the pedal bases 5 and 6 through universal connectors 75 and 85. Therefore, the left and right rocker arm mechanisms and the left and right pedal mechanisms can be moved identically.

A first transmitting mechanism is rotatably installed to the inclined supporting rod 16 near to a pulley 91 below the upper ends of the tracks 3 and 4 and a steel rope 92 wound the pulley 91. Two ends of the steel rope 92 are connected to the left and right pedal bases 5 and 6 respectively so that the pedal bases 5 and 6 can be slid back and forth, up and down against each other alternately.

Figure 2:
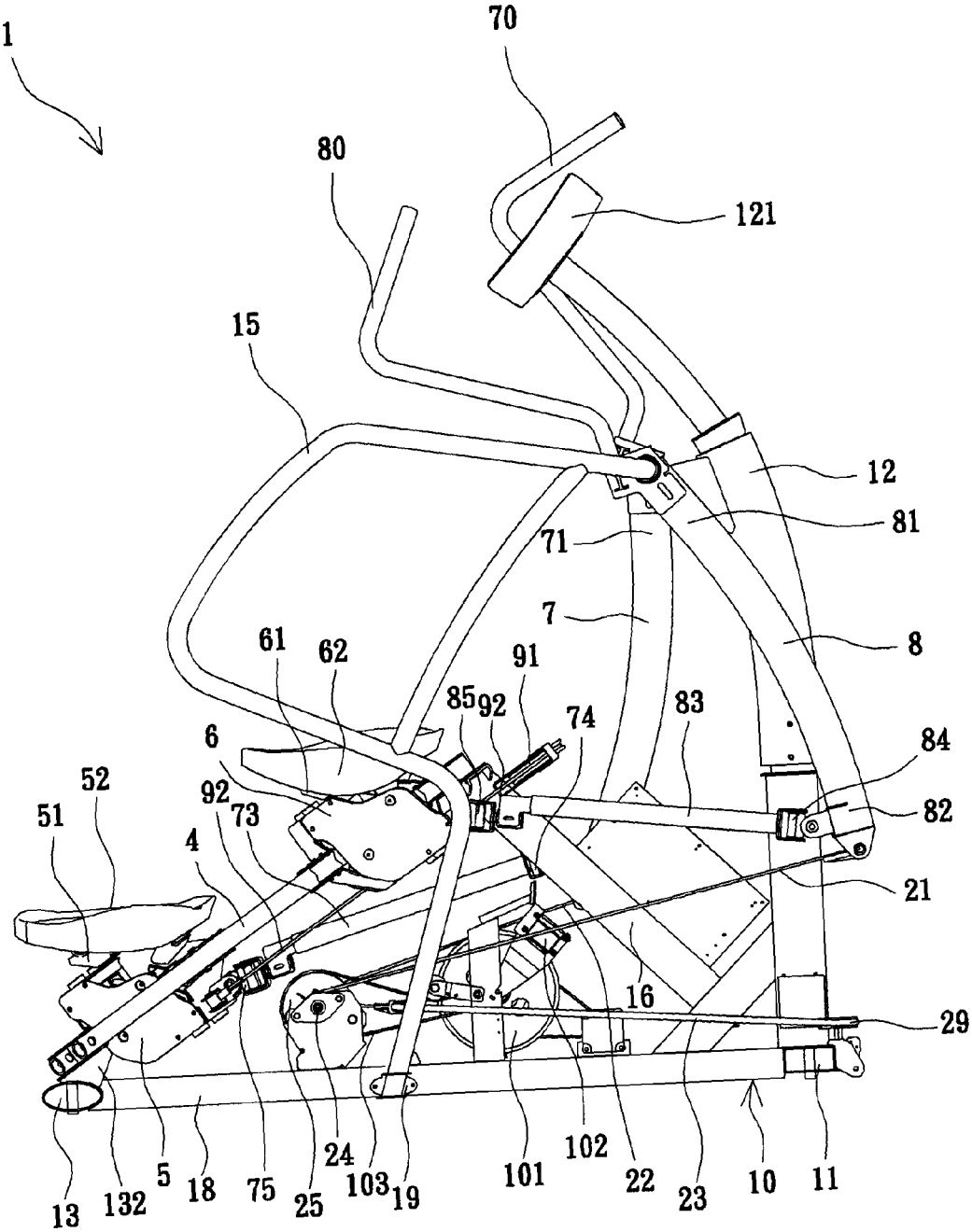
FIG. 2 is a pictorial drawing of the embodiment of the present invention viewing from a side.
Figure 3:
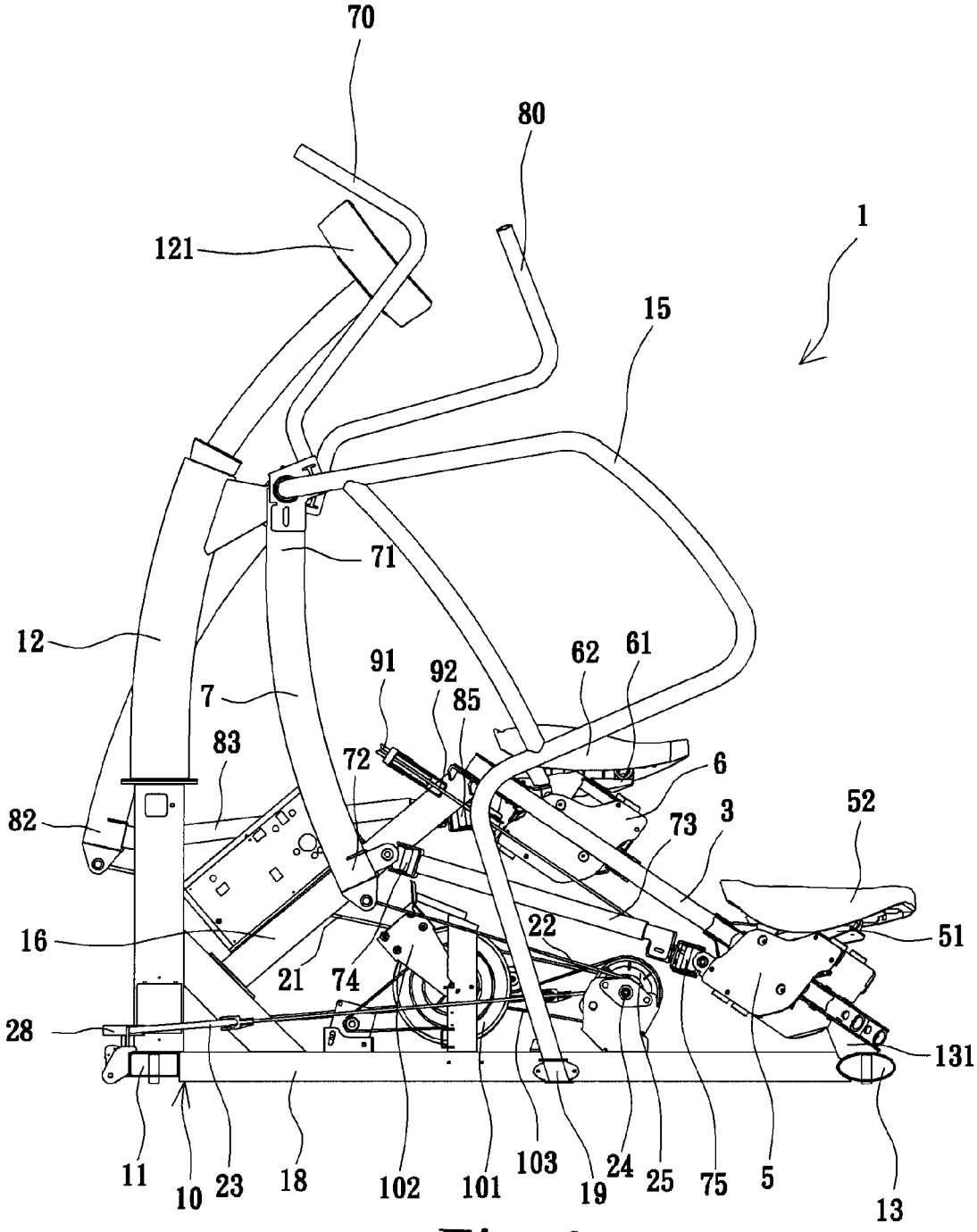
FIG. 3 is a pictorial drawing of the embodiment of the present invention viewing from another side to the FIG. 2.

Referring to FIGS. 1 to 3, a second transmitting mechanism is illustrated. The second transmitting mechanism has two timing belts 21, 22 and an elastic belt 23 linking the two timing belts 21, 22. Outer ends of the timing belts 21, 22 are connected to the lower ends 72, 82 of the rocker arms 7 and 8 respectively so that the left and right rocker arm mechanisms can be swung back and forth alternately with an axle center of the axle rod 14. A shaft rod 24 is installed to the frame 10. A belt wheel 25 is installed to a middle position of the shaft rod 24, and two gear wheels 26, 27 are installed to two ends of the shaft rod 24. The gear wheels 26, 27 have single direction bearing. The timing belts 21, 22 clench the teeth of the gear wheels 26 and 27 respectively. Two wheels 28, 29 are pivoted to two ends of the front bottom rod 11. The elastic belt 23 linking the timing belts 21, 22 also winds the wheels 28 and 29. By the second transmitting mechanism, the left and right rocker arms 7 and 8 can be moved back and forth against each other alternately.

The damping mechanism includes a load wheel 101 and an electro-magnetic brake 102. By the link of a transmitting belt 103, the load wheel 101 is linked to the belt wheel 25. When the handles 70 and 80 are swung back and forth alternately, the damping mechanism can provide a resistance. The resistance can be pre-selected on the control panel 121.

Figure 4:
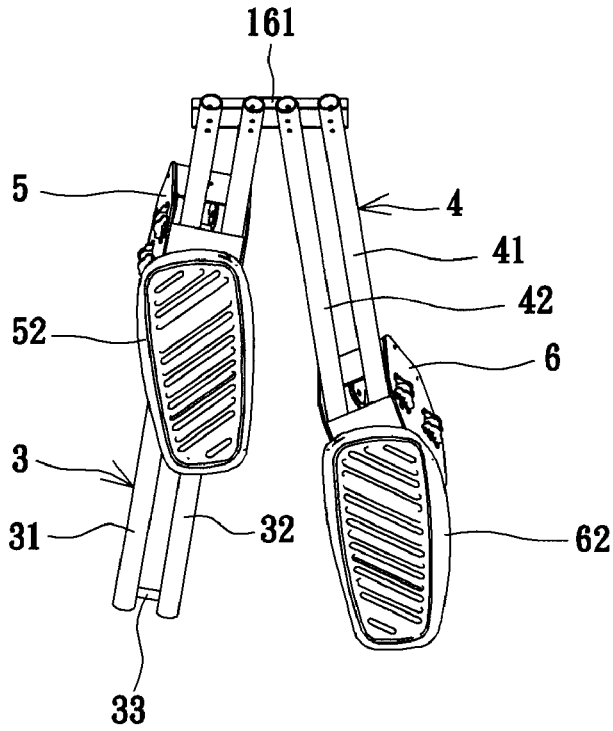
FIG. 4 is a top view showing pedal mechanisms at a back and front positions of tracks.
Figure 5:
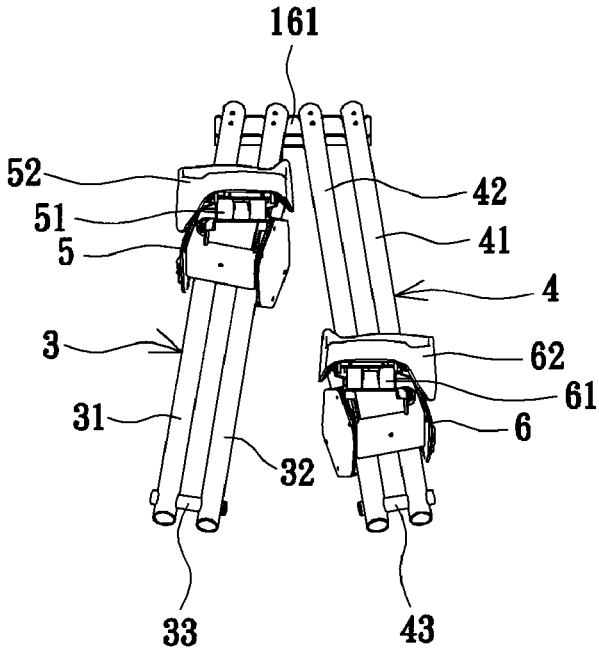
FIG. 5 is a rear view showing the pedal mechanisms at the back and front positions of the tracks.
Figure 6:
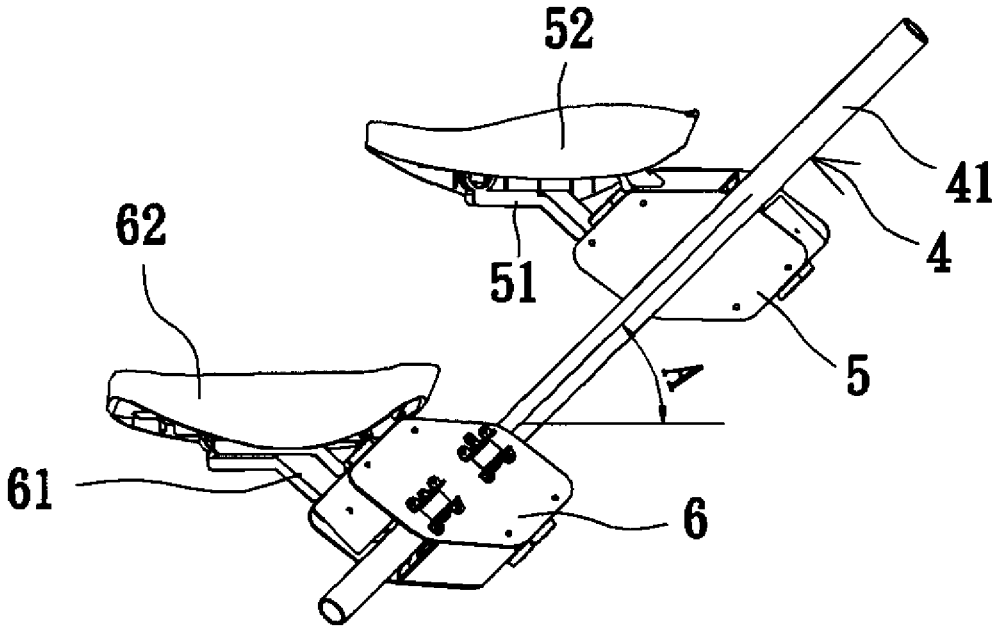
FIG. 6 shows drawing of the FIG. 5 from a side.

With reference to FIGS. 4 to 6, the main characteristic of the left and right tracks 3 and 4 is made of at least one non-parallel linear track. The tracks 3 and 4 of the embodiment of the present invention are non-parallel linear tracks; which are made of two parallel linear pipes 31, 32 and 41, 42 and combined by linking bodies 33, 43 respectively. The upper ends of the linear pipes are all fixed to a common linking unit 161 which is fixed to an upper end of the inclined supporting rod 16. The linking bodies 33 and 43 and the lower ends of the tracks are fixed to the installation portions 131 and 132 so that the tracks are installed to the frame 10 at an angle A to the ground as shown in FIG. 6.

Figure 7:
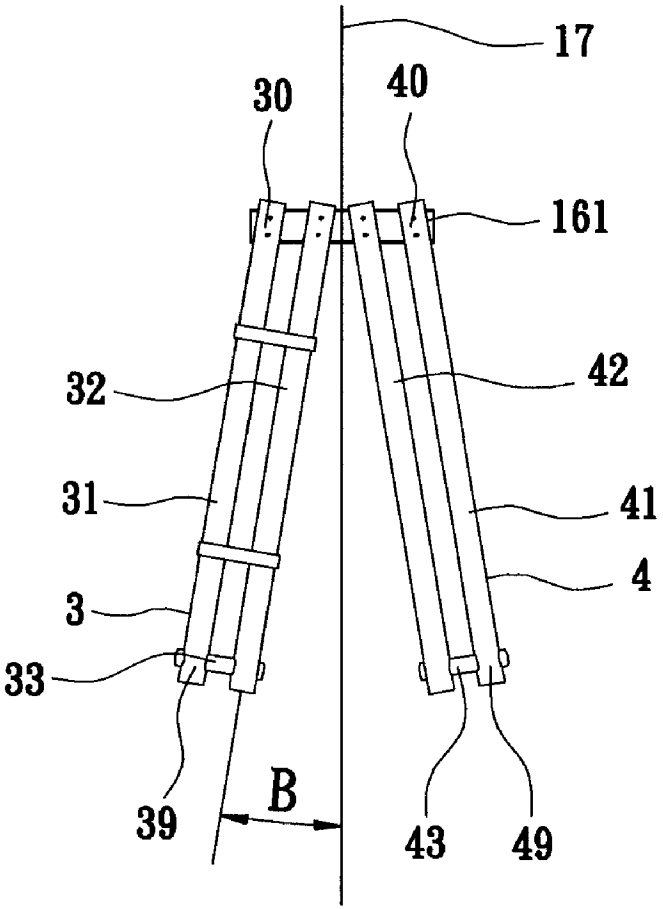
FIG. 7 shows the non-parallel linear tracks oppositely installed to a center line.
Figure 8:
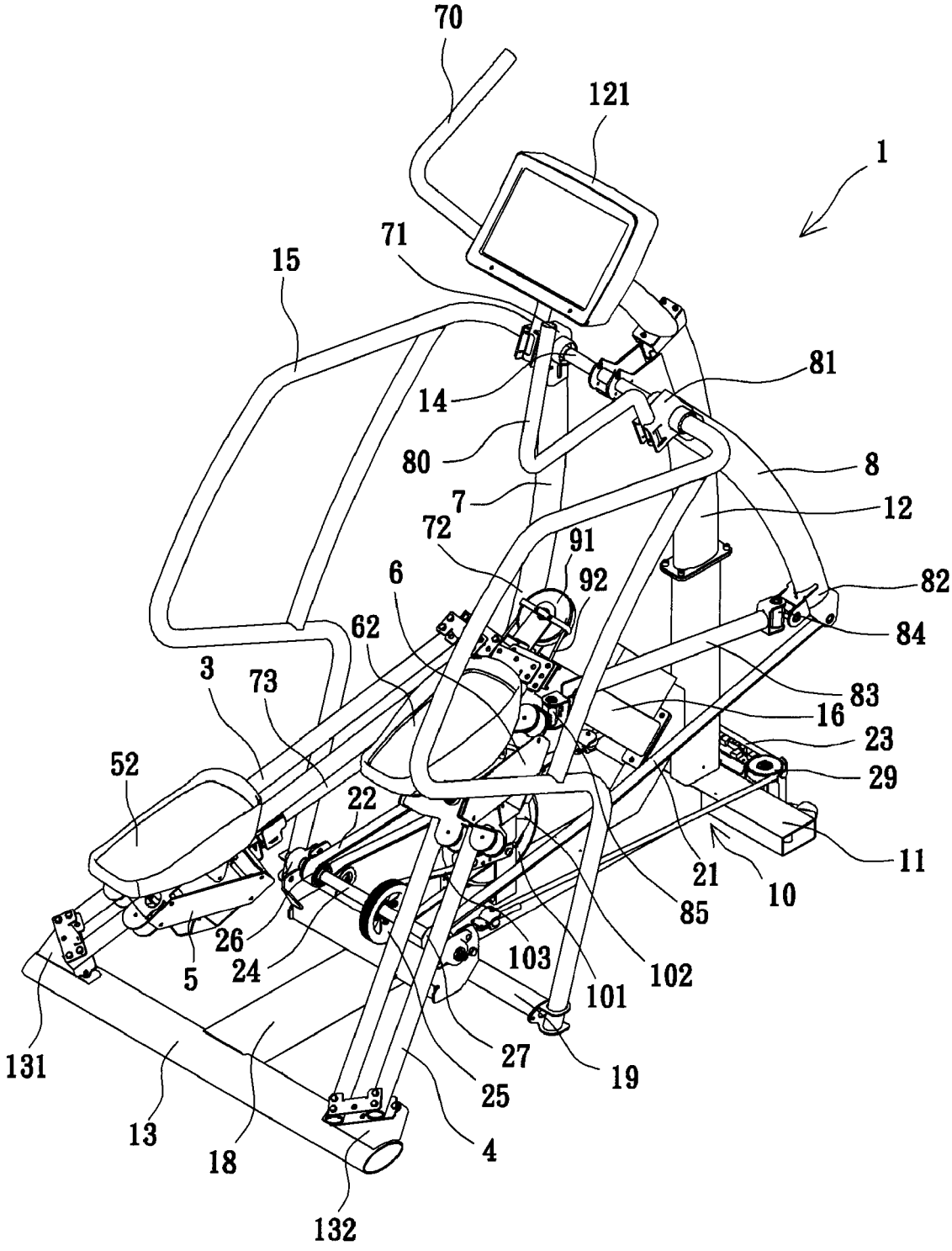
FIG. 8 is a pictorial drawing of the athletic apparatus viewing from a back side.

Referring to FIG. 7, a center line 17 illustrated between the oppositely installed tracks 3 and 4 indicates a longitudinal direction of the base 18 of the present invention. The tracks 3, 4 are non-parallel. After the tracks 3, 4 are installed to be between the rear bottom rod 13 and the center line 17, they are downwards and expanded in the distances therebetween. Namely, the upper ends 30, 40 of the tracks 3, 4, respectively are near the center line 17 and the lower end 39, 49 thereof are far away from the center line 17 so that the opening between the lower ends of the tracks 3, 4 are faced outwards and has an angle B with the center line 17.

When operating the athletic apparatus 1 according to the present invention, a user (not illustrated) stands on the pedals 52 and 62 with both feet respectively and holds the handles 70 and 80 with both hands respectively. While the user overcomes the resistance of the load wheel 101, the rocker arm mechanisms are pulled back and forth and the pedals mechanisms are moved back and forth, up and down against each other alternately in the same time.

The athletic apparatus 1 according to the present invention can provide a composite body exercise for hands and feet of the users. Also, by the design of the non-parallel linear tracks 3 and 4, the pedals bases 5 and 6 will be moved along the non-parallel linear tracks to present non-parallel linear track in the movement so that feet of the user can exercise smoothly by moving outwards and downwards together and moving forth and upwards together.

The pedals 52 and 62 are parallel to the ground on the non-parallel tracks 3 and 4 at a static status. For the balance of the users operating the athletic apparatus 1, as shown in FIG. 5, the pedals 52 and 62 can retain in a horizontal state so that the upwards and downwards movement along the track are smooth and safe.

The athletic apparatus 1 according to the present invention has a simple structure and provides a physical training on muscles of user's arms and feet. Especially to the design of the tracks 3 and 4, the users can exercise inwards and outwards with a non-parallel linear track. Moreover, the rocker arm mechanisms can drive the load wheel 101 through the belt wheel 25 by the link of two timing belts on the same axis to the belt wheel 25. On the other hand, the rocker arm mechanisms can drive the corresponding pedal mechanisms on the left and right tracks 3, 4 synchronously by the link of linking rods 73 and 83 so that the athletic apparatus 1 can archive an anticipated purpose and effect.

Figure 9:
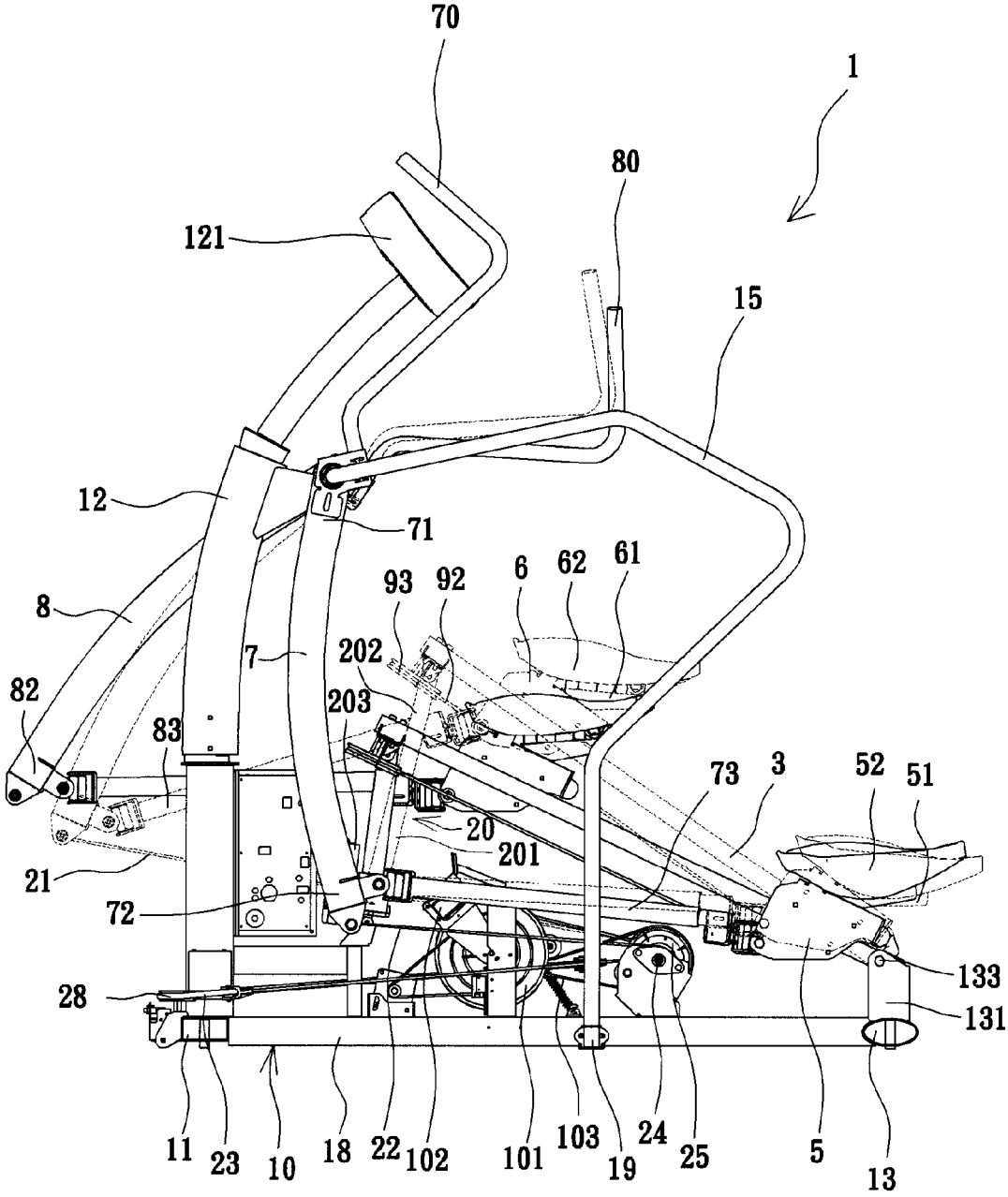
FIG. 9 is a lateral view of an athletic apparatus in another embodiment of the present invention, wherein a screw rod screwedly moves along the track.
Figure 10:
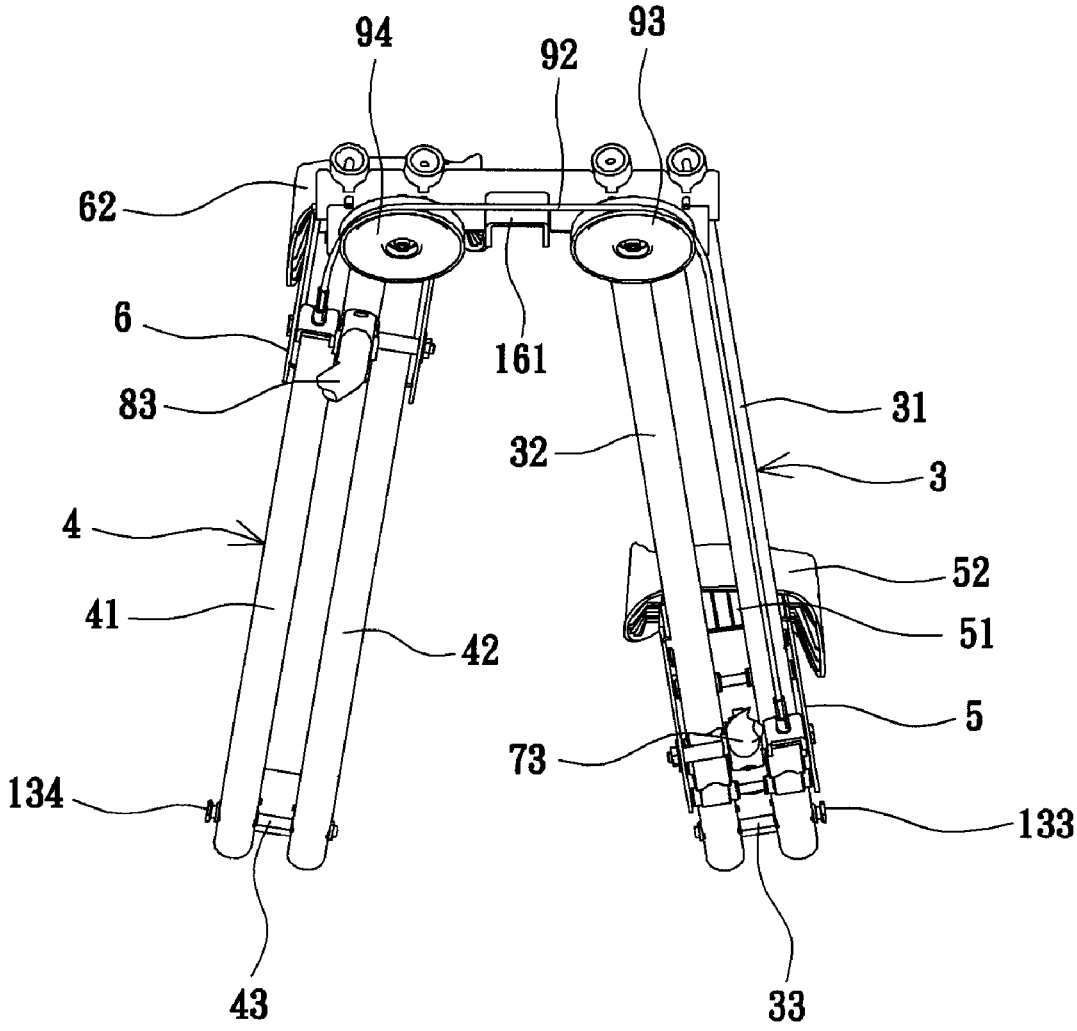
FIG. 10 is a front view which shows that the pedals in FIG. 9 are positioned on the track with one being at the front side and another being at a rear side.

Another embodiment of the present invention is illustrated in FIGS. 9 and 10, it is illustrated that the first transmitting mechanism is rotatably installed to the tracks 3, 4 and are positioned to the pulleys 93, 94 of the tracks 3, 4, respectively (as shown in FIG. 10). The lower ends of the tracks 3, 4 are rotatably installed to the installation portions 131, 132. The tracks 3, 4 are swingable along the axles 133, 134 of the installation portions 131, 132, respectively. The upper ends of the tracks 3, 4 are retained by a screwing unit 20 which is installed to the frame 10. The tracks 3, 4 are supported and positioned by the screwing unit 20 so as to form with an incline angle A with the ground. The screwing unit 20 has an outer tube 201 retained to the frame 10, an inner tube 202 telescopically moved in the outer tube 201 and a motor 203 for driving the inner tube 202. A top end of the inner tube 202 serves to pivotally support a connecting unit 161 which serve to position the upper ends of the tracks 3, 4. When the inner tube 202 moves out of the outer tube 201 with a predetermined amount, a moving tracks 3, 4 will rotate along the axles 133, 134, respectively so that the user can adjust a proper inclined angle A.

The structure of the present invention is novel and inventive to the prior art structure. The non-parallel linear tracks are different from the prior art linear and parallel tracks so as to increase the effect in exercise. Thus, the present invention is better than the prior art structure.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An athletic apparatus comprising:

a frame for placement on level ground;

a pair of left and right tracks of the same structure fixed to the frame at a predetermined angle to the ground; the tracks being linear and non-parallel;

a pair of left and right pedal mechanisms of the same structure including pedals for being tread by a user's feet and being installed to the left and right tracks respectively; the pedal mechanisms being movable up and down along the tracks;

a pair of left and right rocker arm mechanisms of the same structure being movably installed to the frame and the left and right pedal mechanisms so as to be moved identically with the pedal mechanisms;

wherein by the tracks being non-parallel, the users experiences the most natural exercise of the feet; and wherein a first transmitting mechanism is rotatably installed to an inclined supporting rod near a pulley below the upper ends of the tracks and a steel rope is wound around the pulley; two ends of the steel rope are connected to the left and right pedals respectively so that the pedals can be slid back and forth, up and down against each other alternately; and a second transmitting mechanism has two timing belts and an elastic belt linking the two timing belts; outer ends of the timing belts are connected to the lower ends of the rocker arms respectively so that the left and right rocker arm mechanisms can be swung back and forth alternately with an axle center of the axle rod; a shaft rod is installed to the frame; a belt wheel is installed to a middle position of the shaft rod, and two gear wheels are installed to two ends of the shaft rod; the gear wheels have single direction bearing; the timing belts clench the teeth of the gear wheels respectively; two wheels are pivoted to two ends of the front bottom rod, and the elastic belt linking the timing belts winds the wheels; by the linking of the second transmitting mechanism, the left and right rocker arm mechanisms can be moved back and forth against each other alternately; and wherein the first transmitting mechanism is rotatably installed to the tracks and are positioned to the pulleys of the tracks, respectively; the lower ends of the tracks are rotatably installed to an installation portions; the tracks are swingable along the axles of the installation portions, respectively; the upper ends of the tracks are retained by a screwing unit which is installed to the frame; the tracks are supported and positioned by the screwing unit so as to form with an incline angle with the ground.

2. The athletic apparatus as claimed in claim 1, wherein the frame has a base which includes a front bottom rod and a rear bottom rod separated from each other; the front bottom rod is formed as a standing rod, a control panel is installed to a top of the standing rod; the users can operate the athletic apparatus through the control panel; an axle rod is formed near an upper end of the standing rod, handles for holding by the user's hands are formed respectively between two ends of the axle rod and a middle bottom rod of the base; installation portions are formed separately to the rear bottom rod.

3. The athletic apparatus as claimed in claim 1, wherein the left and right rocker arm mechanisms have rocker arms with upper ends thereof pivoted to an axle rod, and handles arranged to the rocker arms respectively for holding by the user; lower ends of the rocker arms are pivoted to linking rods through universal connectors respectively; ends of each linking rod are pivoted to the left and right pedal mechanisms through universal connectors; therefore, the left and right rocker arm mechanisms and the left and right pedal mechanisms can be moved identically.

4. The athletic apparatus as claimed in claim 1, wherein the left and right pedal mechanisms have pedal bases, supporters installed on the pedal bases, and pedals for treading by the user's feet respectively; the pedal bases are slidably installed to the non-parallel linear tracks respectively and capable of being slid up and down along the tracks.

5. The athletic apparatus as claimed in claim 1, wherein bottom ends of the tracks are fixed to the installation portions of the rear bottom rods respectively, while upper ends of the tracks are fixed to an inclined supporting rod of the frame so that the left and right tracks are at a predetermined angle to the ground.

6. The athletic apparatus as claimed in claim 1, wherein a damping mechanism is installed to the frame; the damping mechanism includes a load wheel and an electro-magnetic brake; by the link of a transmitting belt, the load wheel is linked to the belt wheel; when the handles are swung back and forth alternately, the damping mechanism can provide a resistance.

7. The athletic apparatus as claimed in claim 1, wherein the left and right tracks are respectively made of two combined linear pipes.

8. The athletic apparatus as claimed in claim 2, wherein a center line of a longitudinal direction of the base is defined as a center line and the left and right tracks are oppositely installed beside the line; the tracks are non-parallel linear tracks; after the tracks are installed to be between the rear bottom rod and the center line, the upper ends of the tracks, respectively are near the center line and the lower end thereof are far away from the center line so that the opening between the lower ends of the tracks are faced outwards and has an angle with the center line.

9. The athletic apparatus as claimed in claim 1, wherein the pedals are parallel to the ground on the tracks at a static status; the pedals can tilt towards each other with a predetermined angle so that the upwards and downwards movements of the pedals along an arcs are smooth and safe; in order not to affect the balance of the user by a non-parallel linear trace from the pedal, the pedal is retained in horizontal state with the non-parallel linear trace of the tracks, and thus the pedal is moved up and down along a non-parallel trace.

10. The athletic apparatus as claimed in claim 1, wherein the screwing unit has an outer tube retained to the frame, an inner tube telescopically moved in the outer tube and a motor for driving the inner tube; a top end of the inner tube serves to pivotally support a connecting unit which serve to position the upper ends of the tracks; when the inner tube moves out of the outer tube with a predetermined amount, a moving tracks will rotate along the axles, respectively so that the user can adjust a proper inclined angle.

* * * * *